United States Patent [19]

Nagayama et al.

[11] Patent Number: 4,693,916

[45] Date of Patent: Sep. 15, 1987

[54] METHOD OF DEPOSITING A SILICON DIOXIDE FILM

[75] Inventors: Hirotsugu Nagayama, Nishinomiya; Hisao Honda, Itami; Hideo Kawahara, Toyonaka, all of Japan

[73] Assignee: Nippon Sheet Glass Co., Ltd., Osaka, Japan

[21] Appl. No.: 882,428

[22] Filed: Jul. 7, 1986

[30] Foreign Application Priority Data

Jul. 19, 1985 [JP] Japan ..... 60-159457

[51] Int. Cl.[4] ..... B05D 1/18

[52] U.S. Cl. ..... 427/397.7; 427/169; 427/435; 427/443.2; 106/287.34; 252/313.2

[58] Field of Search ..... 252/313.2; 427/397.7, 427/169, 435, 443.2; 106/287.34

[56] References Cited

U.S. PATENT DOCUMENTS 4,468,420 8/1984 Kawahara et al. ..... 427/397.7

*Primary Examiner*—Sam Silverberg

*Assistant Examiner*—Terry J. Owens

*Attorney, Agent, or Firm*—Jones, Day, Reavis & Pogue

[57] ABSTRACT

A method of depositing a silicon dioxide film by bringing a substrate into contact with a hydrosilicofluoric acid solution supersaturated with silicon dioxide by the addition of an additive to deposit silicon dioxide film on the surface of the substrate, wherein the additive is at least one compound selected from the group consisting of an aluminum compound, a calcium compound, a magnesium compound, a barium compound, a nickel compound, a cobalt compound, a zinc compound, and a copper compound, and/or a metal or metals.

7 Claims, No Drawings

METHOD OF DEPOSITING A SILICON DIOXIDE FILM

BACKGROUND OF THE INVENTION

1. Field of the Invention

The present invention relates to a method of depositing a silicon dioxide film and, more particularly, it relates to an improved method of depositing a silicon dioxide film on the surface of a substrate by bringing the substrate into contact with an aqueous solution of hydrosilicofluoric acid supersaturated with silicon dioxide (hereinafter referred to as "liquid phase deposition method").

2. Description of the Prior Art

A conventional method of depositing a silicon dioxide film on the surface of any substrate is described in Japanese Patent Application Laid-open No. 1982/196744. According to this method, hydrosilicofluoric acid having a concentration of 0.5 to 3.0 mole/l is saturated with silicon dioxide, and then, boric acid is added to the hydrosilicofluric acid solution saturated with silicon dioxide in the amount of $2.0\times10^{-2}$ mol or more per 1 of the hydrosilicofluoric acid solution to prepare a treating solution which is supersaturated with silicon dioxide, and a substrate is dipped in the treating solution. Another conventional method of depositing a silicon dioxide film on the surface of any substrate is described in Japanese Patent Application Laid-open No. 1983/161944. According to this method, the supersaturation state with silicon dioxide is maintained for a certain period by continuously adding boric acid to the above-mentioned treating solution (Patent application laid-open No. 1983/161944).

The above conventional liquid phase deposition methods have advantages that the deposition of the film is possible at a low temperature, and that it is possible to deposit on substrates of any material and any shape, but it has a disadvantage, on the other hand, that a complicated process is required for the detoxifying treatment of the effluent of the used treating solution to be discarded.

In a fluorine-containing effluent, fluorine is generally separated and removed as $CaF_2$ precipitate formed by adding $Ca(OH)_2$.

The concentration of fluorine in the effluent which is produced in the above-mentioned liquid phase deposition methods cannot readily be decreased, however, by single addition of $Ca(OH)_2$, and it is therefore necessary to repeat many times the cycle of addition of $Ca(OH)_2$, precipitation, and separation.

SUMMARY OF THE INVENTION

Accordingly, it is an object of the present invention to provide a method of depositing a silicon dioxide film, wherein a detoxifying treatment for an effluent can be simply performed to decrease the fabrication cost and provide environmental protection effect, and at the same time, a uniform silicon dioxide film can be formed on the surface of a substrate in the same manner as in the conventional methods.

In order to achieve the above object of the present invention, there is provided a method of depositing a silicon dioxide film by bringing a substrate into contact with a hydrosilicofluoric acid solution supersaturated with silicon dioxide by the addition of an additive to deposit a silicon dioxide film on the surface of the substrate, wherein an additive is at least one compound selected from the group consisting of an aluminum compound, a calcium compound, a magnesium compound, a barium compound, a nickel compound, a cobalt compound, a zinc compound, and a copper compound, and/or a metal or metals.

DESCRIPTION OF THE PREFERRED EMBODIMENT

A metal used in the present invention must be able to react with hydrosilicofluoric acid solution and to be dissolved therein, thus, a metal excluding noble metals such as Pt and Rh can be used, examples of such a metal being Al, Fe, Mg, and so on. Among these metals, Al is preferable since the detoxifying treatment thereof is simple.

Aluminum compounds, calcium compounds, magnesium compounds, barium compounds, nickel compounds, cobalt compounds, zinc compounds, and copper compounds used in the present invention are the compounds which react with HF, where chlorides, nitrates, sulfates, and the like, other than fluorides, can be used, with the chlorides being preferred.

The hydrosilicofluoric acid solution to be brought into contact with a metal or added with a compound is preferably a solution which is easily supersaturated with silicon dioxide by the above operation, i.e., a hydrosilicofluoric acid solution saturated with silicon dioxide. The hydrosilicofluoric acid solution saturated with silicon dioxide can be prepared by dissolving a silicon dioxide source (silica gel, silica glass, and so on) in a hydrosilicofluoric acid solution.

The contact of metal with the hydrosilicofluoric acid solution is performed by adding metal powder in the solution or dipping a metal piece in the solution, and so on. The degree of supersaturation of silicon dioxide in hydrosilicofluoric acid is determined by the amount of addition of metal (the amount consumed by the reaction) and the state of the solution prior to the addition, the amount of addition of the metal being preferably 0.01 to 1 mole per 1 mole of hydrosilicofluoric acid present prior to the contact with the metal.

When the amount of addition of the metal is smaller than 0.01 mol per 1 mol of hydrosilicofluoric acid in the solution, the silicon dioxide film cannot properly be deposited due to the low degree of supersaturation of silicon dioxide even if the hydrosilicofluoric acid saturated with silicon dioxide described above is used. When, however, the metal, whose mole number is larger than that of hydrosilicofluoric acid prior to the addition of the reagent, is added and brought into reaction, the solution undesirably tends to precipitate silicon dioxide.

The above described compound can be added in a solid form such as powder to the hydrosilicofluoric acid solution, however, addition of the compound as an aqueous solution is preferred because of its easy handling and mixing.

The amount of the compound added to hydrosilicofluoric acid is preferably 0.01 to 1 mole per 1 mole of hydrosilicofluoric acid present in the solution prior to addition of the compound.

The conventional deposition methods described above have utilized the following two equilibrium:

$$H_2SiF_6+2H_2O\rightleftharpoons 6HF+SiO_2 \quad (1)$$

$$H_3BO_3+4HF\rightleftharpoons HBF_4+3H_2O \quad (2)$$

and $SiO_2$ was deposited on the surface of a substrate, the solution being supersaturated with $SiO_2$ by the addition of $H_3BO_3$.

It was found, however, that since $HBF_4(BF_4^-$ ion) produced in the above described equilibrium has high bonding energy of B-F, the efficiency of the reaction with $Ca(OH)_2$ in the detoxifying treatment of the effluent is poor and $HBF_4$ remains as fluorine-containing ion in the effluent after settling-separation.

The method of depositing a silicon dioxide film utilizes the equilibrium (1) described above and reactions such as the following reactions:

$$M + xHF \rightarrow MFx + x/2H_2 \quad (3)$$

wherein M represents a metal, $$Al^{3+} + 3HF \rightarrow AlF_3 + 3H^+ \quad (4)$$

$$Ca^{2+} + 2HF \rightarrow CaF_2 + 2H^+ \quad (5)$$

$$Mg^{2+} + 2HF \rightarrow MgF_2 + 2H^+ \quad (6)$$

Fluorine-containing ions in the effluent produced in the deposition method according to the present invention are mainly $F^-$ (HF) and $SiF_6^{2-}$ ($H_2SiF_6$) ions, where HF and $H_2SiF_6$ can easily be separated from the solution according to the following reaction:

$$2HF + Ca(OH)_2 \rightarrow CaF_2 + 2H_2O \quad (7)$$

$$H_2SiF_6 + Ca(OH)_2 \rightarrow CaSiF_6 + 2H_2O \quad (8)$$

The invention will be understood more readily by reference to the following example; however, the example is intended to illustrate the invention and is not to be construed to limit the scope of the invention.

EXAMPLE

Silicon dioxide (industrial silica gel) was dissolved in hydrosilicofluoric acid solution having the concentration of 2 moles/l to prepare a solution saturated with silicon dioxide. Ten 300-ml samples were taken from the resultant solution, and, (A) 0.006 mole of boric acid, (B) 0.0168 mole of aluminum chloride, (C) 0.138 mole of calcium chloride, (D) 0.114 mole of magnesium sulfate, (E) 0.009 mole of barium chloride, (F) 0.51 mole of nickel chloride, (G) 0.372 mole of cobalt chloride, (H) 0.24 mole of zinc chloride, and (I) 0.198 mole of copper chloride were added to nine solutions among the above ten solutions, respectively. And (J) a 50 mm long, 25 mm wide, and 3 mm thick aluminum plate (about 0.38 mole) was added in the rest of 300-ml solution.

Since hydrogen gas was produced by the addition of aluminum plate, the reaction was performed, taking care of ventilation.

Each solution was converted into hydrosilicofluoric acid solution supersaturated with silicon dioxide by the addition of the reagent described above.

Ten treating solutions described above were placed on a water bath at 35° C., and eleven square soda lime glass plates each having a side of 5 cm and a thickness of 1 mm sufficiently dried in advance were then dipped in each of these treating solutions.

The plates, after being dipped for 16 hours, were removed, washed, and then dried.

Uniform silicon dioxide coating was deposited on the surface of each of the dipped glass plates. Thicknesses of the silicon dioxide coatings formed by each of the treating solutions were measured by a thickness gauge (Talisurf). The results are shown in Table 1.

As is apparent from Table 1, the silicon dioxide coating of substantially the same thickness was formed on the surface of each glass plate by the above operation.

Each of the treating solutions after removal of the glass substrates in the above operation was diluted 10 times and $Ca(OH)_2$ was added with stirring to each solution until the pH became 12. Each solution was filtered through paper filter, and the concentration of fluorine in the filtrate was determined by quantitative masurement, using a fluorine ion meter. The results are shown in Table 1.

It is understood from Table 1 that the concentration of fluorine ion is so low that the treatment of fluorine ion is easy, except for the case of the treating solution (A) where boric acid is used.

TABLE 1

| | Thickness of Deposited Film (nm) | Concentration of Fluorine after $Ca(OH)_2$ Treatment (ppm) |
|---|---|---|
| (A) $H_3BO_3$ | 100 | 104 |
| (B) $AlCl_3$ | 120 | 12 |
| (C) $CaCl_2$ | 125 | 9.2 |
| (D) $MgSO_4$ | 110 | 14 |
| (E) $BaCl_2$ | 95 | 10 |
| (F) $NiCl_2$ | 105 | 13 |
| (G) $CoCl_2$ | 100 | 12 |
| (H) $ZnCl_2$ | 110 | 9.0 |
| (I) $CuCl_2$ | 125 | 11 |
| (J) Al | 120 | 13 |

What is claimed is:

1. A method of depositing a silicon dioxide film on a substrate comprising the steps of adding a metal-containing material to a hydrosilicofluoric acid solution to supersaturate the solution with silicon dioxide, then immersing the substrate in the solution to deposit a silicon dioxide film on the substrate.

2. A method according to claim 1, wherein the metal-containing material is added in an amount of 0.01 to 1 mole per 1 mole of hydrosilicofluoric acid present in the hydrosilicofluoric acid solution prior to addition of the metal-containing compound.

3. The method according to claims 1 or 2 wherein the metal-containing material is at least one metal.

4. The method according to claim 3 wherein the at least one metal is least one metal selected from the group consisting of Al, Fe, and Mg.

5. The method according to claim 4 wherein the at least one metal is Al.

6. The method according to claims 1 or 2 wherein the metal-containing material is at least one compound selected from the group consisting of an aluminum compound, a calcium compound, a magnesium compound, a barium compound, a nickel compound, a cobalt compound, a zinc compound, and a copper compound.

7. The method according to claim 6 wherein the at least one compound is a chloride.

* * * * *